US011270610B2

(12) United States Patent
Shim et al.

(10) Patent No.: US 11,270,610 B2
(45) Date of Patent: Mar. 8, 2022

(54) DISPLAY PANEL INSPECTING APPARATUS AND DISPLAY APPARATUS HAVING THE SAME

(71) Applicant: Samsung Display Co., Ltd., Yongin-Si (KR)

(72) Inventors: Chan Wook Shim, Asan-si (KR); Ji Ho Moon, Hwaseong-si (KR); In Cheol Song, Daejeon (KR); Chang Gil Oh, Cheonan-si (KR); Seong Keun Cho, Seoul (KR); Sae Mi Han, Seoul (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/952,637

(22) Filed: Nov. 19, 2020

(65) Prior Publication Data

US 2021/0225222 A1 Jul. 22, 2021

(30) Foreign Application Priority Data

Jan. 22, 2020 (KR) ..... 10-2020-0008681

(51) Int. Cl.
*G09G 3/00* (2006.01)

(52) U.S. Cl.
CPC ..... *G09G 3/006* (2013.01); *G09G 2300/0809* (2013.01); *G09G 2330/12* (2013.01)

(58) Field of Classification Search
CPC ..... G09G 3/006; G09G 2300/0809; G09G 2330/12; G09G 2300/0426; G09G 2300/0452
See application file for complete search history.

(56) References Cited

U.S. PATENT DOCUMENTS 9,087,475 B2 * 7/2015 Lu ..... G09G 3/006
2008/0123012 A1 * 5/2008 Ohtomo ..... G02F 1/1368 349/54
2008/0203391 A1 * 8/2008 Kim ..... G09G 3/3611 257/59
2008/0284697 A1 * 11/2008 Nam ..... G02F 1/136209 345/87
2011/0279746 A1 * 11/2011 Kim ..... G09G 3/3648 349/54

(Continued)

FOREIGN PATENT DOCUMENTS

KR 101949257 B1 2/2019

*Primary Examiner* — Jose R Soto Lopez
(74) *Attorney, Agent, or Firm* — Cantor Colburn LLP

(57) ABSTRACT

A display panel inspecting apparatus includes a first inspecting transistor including a control electrode for receiving a first test gate signal, an input electrode for receiving a first voltage and an output electrode connected to an outermost data line disposed in an outermost area of a display region of a display panel, a second inspecting transistor including a control electrode for receiving the first test gate signal, an input electrode for receiving a second voltage and an output electrode connected to a normal data line disposed out of the outermost area of the display region, and a third inspecting transistor including a control electrode for receiving the first test gate signal, an input electrode for receiving a third voltage and an output electrode connected to a module crack inspecting data line disposed out of the outermost area of the display region.

20 Claims, 10 Drawing Sheets

(56) References Cited

U.S. PATENT DOCUMENTS

2012/0162165 A1* 6/2012 Lee ..... G09G 3/006 345/206
2013/0335397 A1* 12/2013 Kim ..... G09G 3/3233 345/212
2014/0167769 A1* 6/2014 Kim ..... G09G 3/006 324/414
2014/0176844 A1* 6/2014 Yanagisawa ..... G09G 3/006 349/43
2014/0354285 A1* 12/2014 Kim ..... G09G 3/3233 324/414
2014/0354286 A1* 12/2014 Kim ..... G09G 3/3225 324/414
2015/0090961 A1* 4/2015 Lee ..... G09G 3/006 257/40
2015/0241501 A1* 8/2015 Jang ..... G09G 3/006 324/527
2015/0347793 A1* 12/2015 Hsiao ..... G06K 19/0722 340/10.5
2016/0043010 A1* 2/2016 Kwak ..... H01L 51/0024 257/48
2016/0078792 A1* 3/2016 Chang ..... G01R 31/28 324/555
2016/0225312 A1* 8/2016 Byun ..... G09G 3/006
2016/0260367 A1* 9/2016 Kwak ..... G09G 3/006
2016/0267826 A1* 9/2016 Seo ..... G09G 3/006
2016/0293078 A1* 10/2016 Byun ..... G09G 3/006
2016/0322451 A1* 11/2016 Park ..... G09G 3/006
2016/0351093 A1* 12/2016 Kim ..... G09G 3/2092
2016/0372017 A1* 12/2016 Byun ..... G09G 3/20
2017/0162094 A1* 6/2017 Jee ..... G09G 3/3266
2017/0213490 A1* 7/2017 Jeong ..... G09G 3/006
2017/0263880 A1* 9/2017 Lee ..... H01L 27/3244
2017/0328703 A1* 11/2017 Dun ..... G01J 1/42
2018/0033354 A1* 2/2018 Lee ..... G09G 3/006
2018/0033355 A1* 2/2018 Lee ..... H01L 27/3223
2018/0069030 A1* 3/2018 Zhang ..... H01L 27/14636
2018/0076102 A1* 3/2018 Ka ..... H01L 27/3262
2018/0158741 A1* 6/2018 Kim ..... G09G 3/006
2018/0330653 A1* 11/2018 Zhou ..... G02F 1/13452
2018/0350284 A1* 12/2018 Park ..... G09G 3/006
2019/0294290 A1* 9/2019 Pu ..... G06F 11/2221
2020/0025820 A1* 1/2020 Zhao ..... G09G 3/3208
2020/0185428 A1* 6/2020 Um ..... G02F 1/133345
2020/0343270 A1* 10/2020 Huang ..... G09G 3/006

* cited by examiner

DISPLAY PANEL INSPECTING APPARATUS AND DISPLAY APPARATUS HAVING THE SAME

This application claims priority to Korean Patent Application No. 10-2020-0008681, filed on Jan. 22, 2020, and all the benefits accruing therefrom under 35 U.S.C. § 119, the content of which in its entirety is herein incorporated by reference.

BACKGROUND

1. Field

Example embodiments of the present inventive concept relate to an inspecting apparatus for a display panel and a display apparatus including the inspecting apparatus. More particularly, example embodiments of the present inventive concept relate to an inspecting apparatus for a display panel improving a reliability of the inspection and a display apparatus including the inspecting apparatus.

2. Description of the Related Art

A display panel inspecting part may be disposed in a peripheral area of a display panel to operate a lighting-on inspection, an open-short inspection, a module crack inspection and so on. When a test image having a uniform luminance for an entire area of the display panel is used for the lighting-on inspection, a defect due to a non-deposition of an organic light emitting element in an outermost area of the display panel may not be easily detected in a visual inspection or an optical inspection.

SUMMARY

Example embodiments of the present inventive concept provide an inspecting apparatus for a display panel for improving a reliability of inspection without enlarging a dead space of the display panel.

Example embodiments of the present inventive concept also provide a display apparatus including the inspecting apparatus for the display panel.

In an example display panel inspecting apparatus according to the present inventive concept, the display panel inspecting apparatus includes a first inspecting transistor, a second inspecting transistor and a third inspecting transistor. The first inspecting transistor includes a control electrode which receives a first test gate signal, an input electrode which receives a first voltage and an output electrode connected to a first outermost data line disposed in an outermost area of a display region of a display panel. The second inspecting transistor includes a control electrode which receives the first test gate signal, an input electrode which receives a second voltage and an output electrode connected to a normal data line disposed out of the outermost area of the display region of the display panel. The third inspecting transistor includes a control electrode which receives the first test gate signal, an input electrode which receives a third voltage and an output electrode connected to a module crack inspecting data line disposed out of the outermost area of the display region of the display panel.

In an example embodiment, the first voltage may be a first color grayscale voltage.

In an example embodiment, the display panel inspecting apparatus may further include a fourth inspecting transistor comprising a control electrode which receives the first test gate signal, an input electrode which receives the first voltage and an output electrode connected to a second outermost data line disposed in the outermost area of the display region of the display panel and adjacent to the first outermost data line.

In an example embodiment, the display panel inspecting apparatus may further include a fourth inspecting transistor comprising a control electrode which receives the first test gate signal, an input electrode which receives a fourth voltage and an output electrode connected to a second outermost data line disposed in the outermost area of the display region of the display panel and adjacent to the first outermost data line.

In an example embodiment, the fourth voltage may be a first color grayscale voltage. The first voltage may be a second color grayscale voltage.

In an example embodiment, the second voltage may be an inspection direct current ("DC") voltage. The first voltage may be a voltage having a level reduced from the second voltage by a resistor.

In an example embodiment, the input electrode of the first inspecting transistor may be floated. The first voltage may be a floating voltage.

In an example embodiment, the display panel inspecting apparatus may further include a first driving transistor comprising a control electrode which receives a first driving gate signal, an input electrode which receives a first color grayscale voltage and an output electrode connected to the first outermost data line, a second driving transistor comprising a control electrode which receives a second driving gate signal, an input electrode which receives a second color grayscale voltage and an output electrode connected to the first outermost data line and a third driving transistor comprising a control electrode which receives a third driving gate signal, an input electrode which receives a third color grayscale voltage and an output electrode connected to a second outermost data line disposed in the outermost area of the display region of the display panel and adjacent to the first outermost data line.

In an example embodiment, the first driving gate signal and the second driving gate signal may be alternately activated. The third driving gate signal may maintain an activated status when the first driving gate signal and the second driving gate signal are alternately activated.

In an example embodiment, the second voltage may be an inspection direct current (DC) voltage. The third voltage may be a voltage having a level reduced from the second voltage by a module crack detecting resistor.

In an example embodiment, the module crack detecting resistor may be formed by a module crack detecting line disposed in a peripheral region of the display panel.

In an example embodiment, the display panel inspecting apparatus may further include a first open-short inspecting transistor comprising a control electrode which receives a second test gate signal, an input electrode which receives a first open-short test voltage and an output electrode connected to the first outermost data line and a second open-short inspecting transistor comprising a control electrode which receives the second test gate signal, an input electrode which receives a second open-short test voltage and an output electrode connected to a second outermost data line disposed in the outermost area of the display region of the display panel and adjacent to the first outermost data line.

In an example embodiment, the display panel may display a test pattern. The test pattern may have a first luminance displayed in a left outermost area and a right outermost area of the display region of the display panel and a second luminance displayed in an area between the left outermost area and the right outermost area of the display region of the display panel.

In an example embodiment, the display panel may display a test pattern. The test pattern may have a first luminance displayed in a left outermost area, a right outermost area, an upper outermost area and a lower outermost area of the display region of the display panel and a second luminance displayed in a display region of the display panel except for the left outermost area, the right outermost area, the upper outermost area and the lower outermost area of the display region of the display panel.

In an example display apparatus according to the present inventive concept, the display panel inspecting apparatus includes a first inspecting transistor and a second inspecting transistor. The first inspecting transistor includes a control electrode which receives a first test gate signal, an input electrode which receives a first voltage and an output electrode connected to an outermost data line disposed in an outermost area of a display region of a display panel. The second inspecting transistor includes a control electrode which receives the first test gate signal, an input electrode which receives a second voltage and an output electrode connected to a normal data line disposed out of the outermost area of the display region of the display panel.

In an example display apparatus according to the present inventive concept, the display apparatus includes a display panel and a display panel inspector. The display panel includes a plurality of gate lines, a plurality of data lines and a plurality of subpixels connected to the gate lines and the data lines. The display panel inspector includes a first inspecting transistor, a second inspecting transistor and a third inspecting transistor. The first inspecting transistor includes a control electrode which receives a first test gate signal, an input electrode which receives a first voltage and an output electrode connected to an outermost data line disposed in a first outermost area of the display region of the display panel. The second inspecting transistor includes a control electrode which receives the first test gate signal, an input electrode which receives a second voltage and an output electrode connected to a normal data line disposed out of the outermost area of the display region of the display panel. The third inspecting transistor includes a control electrode which receives the first test gate signal, an input electrode which receives a third voltage and an output electrode connected to a module crack inspecting data line disposed out of the outermost area of the display region of the display panel.

In an example embodiment, the first voltage may be a first color grayscale voltage.

In an example embodiment, the display panel inspector may further include a fourth inspecting transistor comprising a control electrode which receives the first test gate signal, an input electrode which receives the first voltage and an output electrode connected to a second outermost data line disposed in the outermost area of the display region of the display panel and adjacent to the first outermost data line.

In an example embodiment, the display panel inspector may further include a first driving transistor comprising a control electrode which receives a first driving gate signal, an input electrode which receives a first color grayscale voltage and an output electrode connected to the first outermost data line, a second driving transistor comprising a control electrode which receives a second driving gate signal, an input electrode which receives a second color grayscale voltage and an output electrode connected to the first outermost data line and a third driving transistor comprising a control electrode which receives a third driving gate signal, an input electrode which receives a third color grayscale voltage and an output electrode connected to a second outermost data line disposed in the outermost area of the display region of the display panel and adjacent to the first outermost data line.

In an example embodiment, the display panel inspector may further include a first open-short inspecting transistor comprising a control electrode which receives a second test gate signal, an input electrode which receives a first open-short test voltage and an output electrode connected to the first outermost data line, and a second open-short inspecting transistor comprising a control electrode which receives the second test gate signal, an input electrode which receives a second open-short test voltage and an output electrode connected to a second outermost data line disposed in the outermost area of the display region of the display panel and adjacent to the first outermost data line.

According to the inspecting apparatus for the display panel and the display apparatus including the inspecting apparatus, a test pattern representing a relatively high luminance is displayed in the outermost area of the display region of the display panel so that the defect due to a non-deposition of the organic light emitting element in the outermost area of the display region of the display panel may be effectively detected. Thus, the reliability of the inspection of the display panel may be enhanced.

In addition, an outermost inspector to inspect the outermost area of the display region of the display panel may be integrally formed with a module crack inspector so that the reliability of the inspection of the display panel may be enhanced without enlarging the dead space of the display panel.

BRIEF DESCRIPTION OF THE DRAWINGS

The above and other features and advantages of the inventive concept will become more apparent by describing in detailed example embodiments thereof with reference to the accompanying drawings, in which.

DETAILED DESCRIPTION

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein. The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. Hereinafter, the present inventive concept will be explained in detail with reference to the accompanying drawings.

Figure 1:
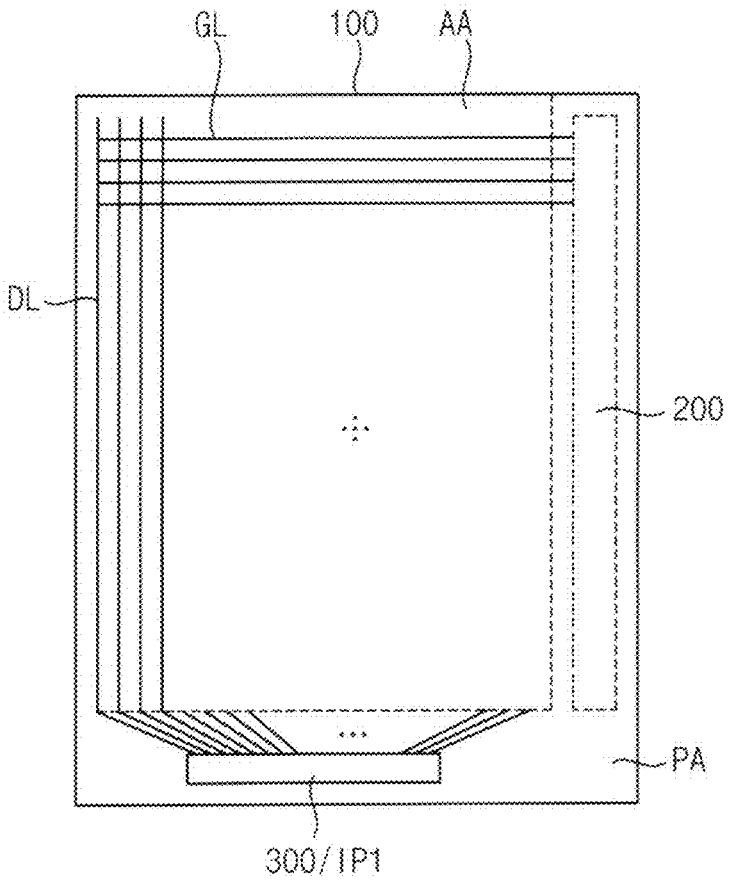
FIG. 1 is a plan view illustrating a display apparatus according to an example embodiment of the present inventive concept.

FIG. 1 is a plan view illustrating a display apparatus according to an example embodiment of the present inventive concept.

Referring to FIG. 1, the display apparatus includes a display panel 100, a display panel inspector IP1 and a display panel driver. The display panel driver includes a gate driver 200 and a data driver 300. The data driver 300 may include a driving controller. Alternatively, the driving controller may be independently disposed out of the data driver 300.

The display panel 100 includes a display region AA on which an image is displayed and a peripheral region PA adjacent to the display region AA. The peripheral region PA may surround the display region AA. The peripheral region PA may be called to a dead space since this region is not used for playing the image.

The display panel 100 includes a plurality of gate lines GL, a plurality of data lines DL, and a plurality of subpixels electrically connected to the gate lines GL and the data lines DL. The gate lines GL extend in a first direction, and the data lines DL extend in a second direction crossing the first direction. The subpixels may be disposed in a matrix form.

A pixel structure of the display panel 100 is explained referring to FIG. 2 in detail, later.

The driving controller receives an input image data and an input control signal from an external apparatus. The input image data may include a red image data, a green image data and a blue image data. The input control signal includes a master clock signal and a data enable signal. The input control signal may further include a vertical synchronizing signal and a horizontal synchronizing signal.

The driving controller generates a first control signal, a second control signal and a data signal based on the input image data and the input control signal.

The driving controller generates the first control signal for controlling a driving timing of the gate driver 200 based on the input control signal, and outputs the first control signal to the gate driver 200.

The driving controller generates the second control signal for controlling a driving timing of the data driver 300 based on the input control signal, and outputs the second control signal to the data driver 300.

The driving controller generates the data signal based on the input image data, and outputs the data signal to the data driver 300.

The gate driver 200 generates gate signals for driving the gate lines GL in response to the first control signal received from the driving controller. The gate driver 200 outputs the gate signals to the gate lines GL.

The gate driver 200 may be integrated on the peripheral region PA of the display panel 100. The gate driver 200 may be mounted on the peripheral region PA of the display panel 100, or may be connected to the peripheral region PA of the display panel 100 as a tape carrier package ("TCP") type from the outside of the peripheral region PA. In FIG. 1, the gate driver 200 is illustrated to be integrated on the peripheral region PA of the display panel 100.

The data driver 300 receives the second control signal and the data signal from the driving controller. The data driver 300 converts the data signal into grayscale voltages. The data driver 300 outputs the grayscale voltages to the data lines DL.

The display panel inspector IP1 may overlap the data driver 300. For example, the display panel inspector IP1 may be integrated on the peripheral region PA of the display panel 100, and the data driver 300 may be mounted as a chip type on a position where the display panel inspector IP1 is disposed.

The display panel inspector IP1 determines whether the subpixels of the display panel 100 normally display the image. For example, the display panel inspector IP1 may inspect whether the subpixels of the display panel 100 normally display the image or not, before mounting the data driver 300 on the display panel 100.

When the inspection of the display panel 100 finishes, the display panel inspector IP1 may be disconnected from the data lines DL. For example, a switching part for connecting or disconnecting the display panel inspector IP1 and the data lines DL may be disposed between the display panel inspector IP1 and the data lines DL.

For example, the display panel inspector IP1 may operate a lighting-on inspection. For example, the display panel inspector IP1 may operate an open-short inspection of the data lines DL. For example, the display panel inspector IP1 may operate a module crack inspection. For example, the display panel inspector IP1 may operate a non-deposition inspection of an organic light emitting element in an outermost area of the display region AA of the display panel 100.

In the lighting-on inspection, the subpixels of the display panel 100 display a specific image, and an inspecting person checks whether the subpixel which is not turned on exists or not. For example, the display panel 100 displays a single color image during the lighting-on inspection. The single color image may be one of a red image, a green image, a blue image, a black image, and a white image.

In the open-short inspection of the data lines DL, by displaying a vertical stripe pattern image on the display panel 100, an open or short of the data line between adjacent data lines are determined. For example, in a normal connection, when a high grayscale value is applied to a first data line and a low grayscale value is applied to a second data line adjacent to the first data line, subpixels connected to the first data line represent high luminance and subpixels connected to the second data line represent low luminance. However, when the first data line is open, the subpixels connected to the first data line may not represent a desired grayscale value. When the second data line is open, the subpixels connected to the second data line may not represent a desired grayscale value. In addition, when the first data line and the second data line are shorted, the subpixels connected to the first data line and the second data line may partially or totally represent the same grayscale value even though different grayscale values are applied to the first and second data lines.

In the module crack inspection, a specific image is displayed on the display panel 100, an area for the module crack inspection is determined in the display panel 100, and a module crack inspection circuit is formed in the area for the module crack inspection. The image displayed in the area for the module crack inspection may be visually inspected using naked eyes or optically inspected using a camera. The module crack inspection circuit may include a module crack detecting line disposed in the peripheral region of the display panel 100 along an edge portion of the display panel 100.

In the non-deposition inspection of the organic light emitting element in the outermost area of the display region AA, a test pattern having a relatively high luminance displayed in the outermost area of the display region AA of the display panel 100 is displayed on the display panel 100, so that the non-deposition of the organic light emitting element in the outermost area of the display region AA may be visually inspected using naked eyes or optically inspected using the camera.

The structure and the operation of the display panel inspector IP1 are explained referring to FIGS. 3 to 7 in detail, later.

Figure 2:
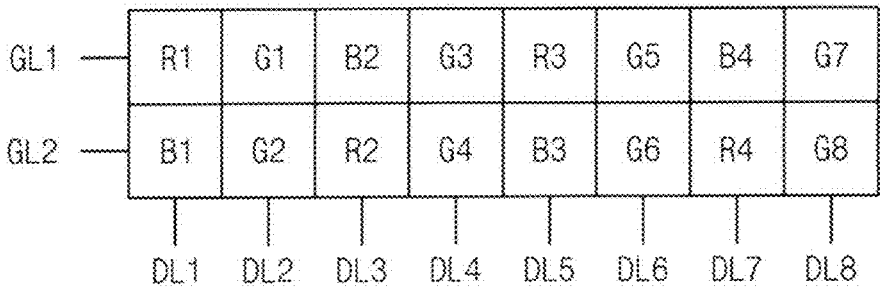
FIG. 2 is a conceptual diagram illustrating an exemplary pixel structure of a display panel of FIG. 1.

FIG. 2 is a conceptual diagram illustrating an exemplary pixel structure of the display panel 100 of FIG. 1.

Referring to FIGS. 1 and 2, the display panel 100 includes a PenTile pixel structure. The display panel 100 may include a plurality of subpixel repeating groups. The subpixel repeating groups are repetitive in this pattern in the first direction and the second direction.

The display panel 100 includes a first data line DL1, a second data line DL2, a third data line DL3 and a fourth data line DL4. The first data line DL1 is connected to a first red subpixel R1 and a first blue subpixel B1. The second data line DL2 is connected to a first green subpixel G1 and a second green subpixel G2. The third data line DL3 is connected to a second blue subpixel B2 and a second red subpixel R2. The fourth data line DL4 is connected to a third green subpixel G3 and a fourth green subpixel G4.

The display panel 100 also includes a fifth data line DL5, a sixth data line DL6, a seventh data line DL7 and an eighth data line DL8. The fifth data line DL5 is connected to a third red subpixel R3 and a third blue subpixel B3. The sixth data line DL6 is connected to a fifth green subpixel G5 and a sixth green subpixel G6. The seventh data line DL7 is connected to a fourth blue subpixel B4 and a fourth red subpixel R4. The eighth data line DL8 is connected to a seventh green subpixel G7 and an eighth green subpixel G8.

Herein, the subpixels of two rows and four columns including the sequence R, G, B, and G in its first row and the sequence B, G, R and G in its second row may form one subpixel repeating group.

Figure 3:
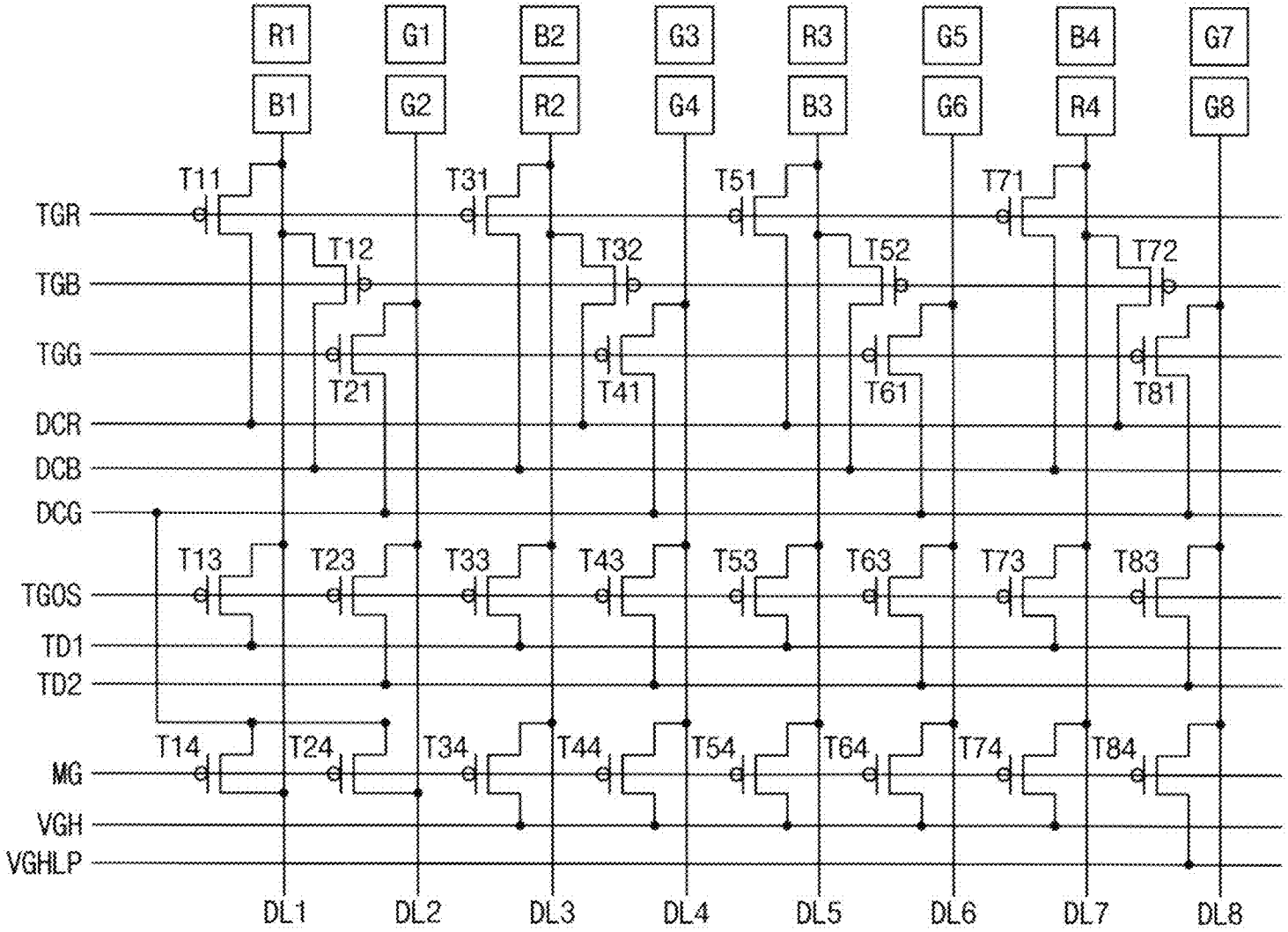
FIG. 3 is a circuit diagram illustrating an exemplary display panel inspector of FIG. 1.
Figure 4:
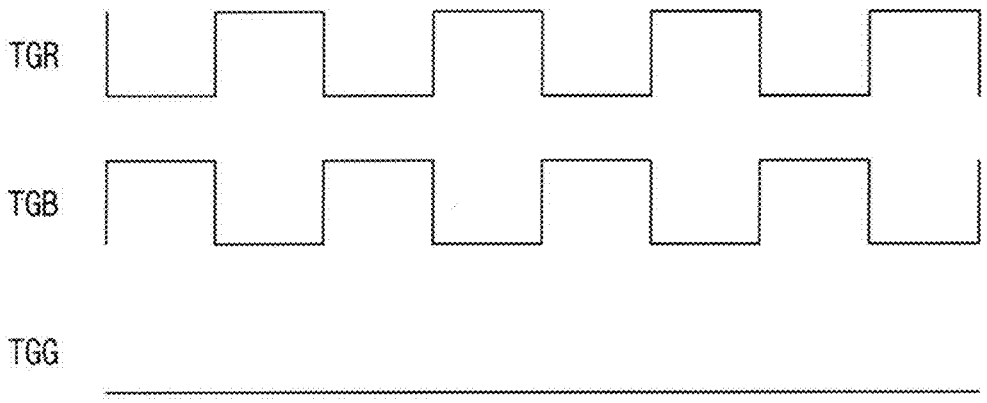
FIG. 4 is a timing diagram illustrating exemplary input signals applied to a lighting-on inspector of FIG. 3.
Figure 5:
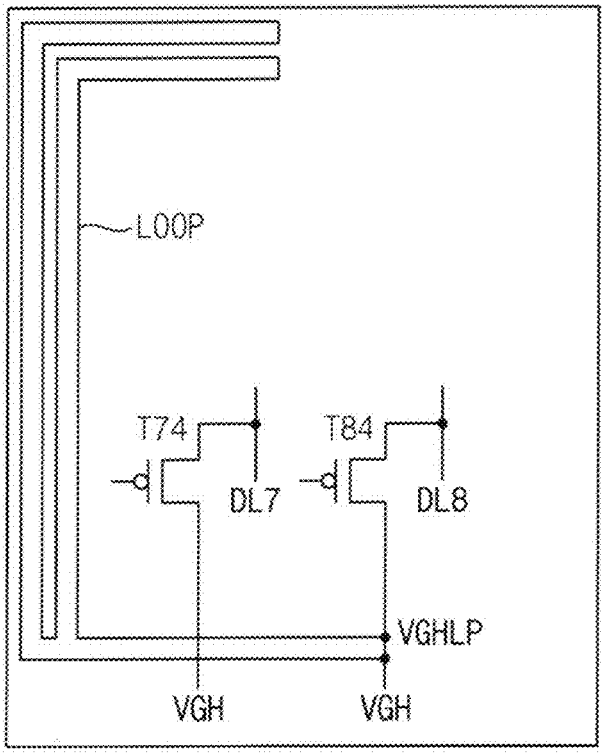
FIG. 5 is a conceptual diagram illustrating a normal inspecting transistor and a module crack inspecting transistor of FIG. 3.
Figure 6:
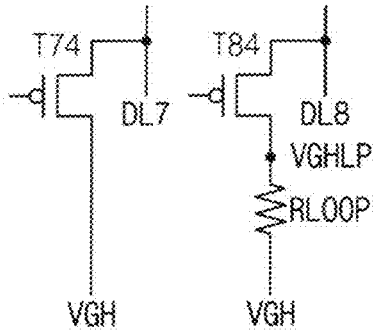
FIG. 6 is a circuit diagram illustrating the normal inspecting transistor and the module crack inspecting transistor of FIG. 3.

FIG. 3 is a circuit diagram illustrating an exemplary display panel inspector IP1 of FIG. 1. FIG. 4 is a timing diagram illustrating exemplary input signals applied to a lighting-on inspector T11, T12 and T21 of FIG. 3. FIG. 5 is a conceptual diagram illustrating a normal inspecting transistor T74 and a module crack inspecting transistor T84 of FIG. 3. FIG. 6 is a circuit diagram illustrating the normal inspecting transistor T74 and the module crack inspecting transistor T84 of FIG. 3.

Referring to FIGS. 1 to 6, the display panel inspector IP1 may include the lighting-on inspector T11, T12, T21, T31, T32, T41, T51, T52, T61, T71, T72 and T81, an open-short inspector T13, T23, T33, T43, T53, T63, T73 and T83 and a module crack and outermost inspector T14, T24, T34, T44, T54, T64, T74 and T84.

When the lighting-on inspector T11, T12, T21, T31, T32, T41, T51, T52, T61, T71, T72 and T81 operates, the open-short inspector T13, T23, T33, T43, T53, T63, T73 and T83 and the module crack and outermost inspector T14, T24, T34, T44, T54, T64, T74 and T84 may not operate.

When the open-short inspector T13, T23, T33, T43, T53, T63, T73 and T83 operates, the lighting-on inspector T11, T12, T21, T31, T32, T41, T51, T52, T61, T71, T72 and T81 and the module crack and outermost inspector T14, T24, T34, T44, T54, T64, T74 and T84 may not operate.

When the module crack and outermost inspector T14, T24, T34, T44, T54, T64, T74 and T84 operates, the lighting-on inspector T11, T12, T21, T31, T32, T41, T51, T52, T61, T71, T72 and T81 and the open-short inspector T13, T23, T33, T43, T53, T63, T73 and T83 may not operate.

In the present example embodiment, the module crack and outermost inspector may include transistors of three different types which are distinguished according to voltages applied to input electrodes. For example, the module crack and outermost inspector may include outermost inspecting transistors T14 and T24 for the outermost inspection, the normal inspecting transistors T34, T44, T54, T64 and T74 and the module crack inspecting transistor T84 for the module crack inspection. As used herein, the term "first voltage" refers to the voltage applied to the input electrode of the outermost inspecting transistor of the module crack and outermost inspector, the term "second voltage" refers to the voltage applied to the input electrode of the normal inspecting transistor of the module crack and outermost inspector, and the term "third voltage" refers to the voltage applied to the input electrode of the module crack inspecting transistor of the module crack and outermost inspector.

A first outermost inspecting transistor T14 may include a control electrode for receiving a first test gate signal MG, an input electrode for receiving a first voltage and an output electrode connected to a first outermost data line DL1, disposed in the outermost area of the display region AA of the display panel 100.

A second outermost inspecting transistor T24 may include a control electrode for receiving the first test gate signal MG, an input electrode for receiving the first voltage and an output electrode connected to a second outermost data line DL2 disposed in the outermost area of the display region AA of the display panel 100 and adjacent to the first outermost data line DL1.

Although the outermost area of the display region AA is defined as an area where the first outermost data line DL1 and the second outermost data line DL2 are disposed for convenience of explanation, ten or more outermost date lines may be disposed in the outermost area for the effective visual inspection in another example embodiment.

Although FIG. 3 illustrates that the outermost area of the display region AA corresponding to the first outermost data line DL1 and the second outermost data line DL2 is disposed in a left edge portion of the display panel 100, the outermost area may also be disposed in a right edge portion of the display panel 100 (corresponding to outermost data lines DLM-1 and DLM when the number of the total data lines is M).

The first normal inspecting transistor T34 includes a control electrode for receiving the first test gate signal MG, an input electrode for receiving a second voltage VGH and an output electrode connected to the third data line DL3 (i.e., first normal data line) of normal data lines disposed out of the outermost area of the display region AA of the display panel 100.

The second normal inspecting transistor T44 includes a control electrode for receiving the first test gate signal MG, an input electrode for receiving the second voltage VGH and an output electrode connected to the fourth data line DL4 (i.e., a second normal data line) of the normal data lines disposed out of the outermost area of the display region AA of the display panel 100.

The third normal inspecting transistor T54 includes a control electrode for receiving the first test gate signal MG, an input electrode for receiving the second voltage VGH and an output electrode connected to the fifth data line DL5 (i.e., a third normal data line) of the normal data lines disposed out of the outermost area of the display region AA of the display panel 100.

The fourth normal inspecting transistor T64 includes a control electrode for receiving the first test gate signal MG, an input electrode for receiving the second voltage VGH and an output electrode connected to the sixth data line DL6 (i.e., a fourth normal data line) of the normal data lines, disposed out of the outermost area of the display region AA of the display panel 100.

The fifth normal inspecting transistor T74 includes a control electrode for receiving the first test gate signal MG, an input electrode for receiving the second voltage VGH and an output electrode connected to the seventh data line DL7 (i.e., a fifth normal data line) of the normal data lines disposed out of the outermost area of the display region AA of the display panel 100.

The module crack inspecting transistor T84 includes a control electrode for receiving the first test gate signal MG, an input electrode for receiving a third voltage VGHLP and an output electrode connected to a module crack inspecting data line DL8 (i.e., the eighth data line) disposed out of the outermost area of the display region AA of the display panel 100.

Although the eighth data line DL8 is designated to the module crack inspecting data line for convenience of explanation in FIG. 3, plural date lines may be designated to the module crack inspecting data lines for the effective visual inspection in another example embodiment.

In the present example embodiment, the first voltage applied to the input electrode of the first outermost inspecting transistor T14 may be a third color grayscale voltage DCG of the lighting-on inspector. The first voltage applied to the input electrode of the second outermost inspecting transistor T24 may be the same third color grayscale voltage DCG of the lighting-on inspector. Herein, the third color grayscale voltage DCG may be a green grayscale voltage. For example, the first voltage may be adjustable by an inspecting person. For example, the first voltage may be adjusted to a direct current (DC) voltage.

In another exemplary embodiment, for example, the second voltage VGH may be a fixed DC voltage. The second voltage VGH may be a voltage for displaying a low luminance image.

When the first voltage represents a high luminance image and the second voltage VGH represents a low luminance image, only the left outermost area and the right outermost area of the display region AA of the display panel 100 display the high luminance image so that the non-deposition of the organic light emitting element which is frequently generated in the outermost area of the display region AA of the display panel 100 may be effectively inspected.

The lighting-on inspector may apply first to third color grayscale voltages DCR, DCB and DCG to the data lines DL1 to DL8 in response to first to third driving gate signals TGR, TGB and TGG.

The lighting-on inspector may function as the data driver 300 before the data driver 300 is connected to the display panel 100.

The lighting-on inspector may include a first driving transistor T11, a second driving transistor T12 and a third driving transistor T21. The first driving transistor T11 may include a control electrode for receiving the first driving gate signal TGR, an input electrode for receiving the first color grayscale voltage DCR and an output electrode connected to the first outermost data line DL1. The second driving transistor T12 may include a control electrode for receiving the second driving gate signal TGB, an input electrode for receiving the second color grayscale voltage DCB and an output electrode connected to the first outermost data line DL1. The third driving transistor T21 may include a control electrode for receiving the third driving gate signal TGG, an input electrode for receiving the third color grayscale voltage DCG and an output electrode connected to the second outermost data line DL2.

The lighting-on inspector may further include a fourth driving transistor T31, a fifth driving transistor T32 and a sixth driving transistor T41. The fourth driving transistor T31 may include a control electrode for receiving the first driving gate signal TGR, an input electrode for receiving the second color grayscale voltage DCB and an output electrode connected to the third data line DL3. The fifth driving transistor T32 may include a control electrode for receiving the second driving gate signal TGB, an input electrode for receiving the first color gray scale voltage DCR and an output electrode connected to the third data line DL3. The sixth driving transistor T41 may include a control electrode for receiving the third driving gate signal TGG, an input electrode for receiving the third color grayscale voltage DCG and an output electrode connected to the fourth data line DL4.

Odd numbered data lines DL1, DL3, DL5 and DL7 are alternately connected to the red subpixels and the blue subpixels. Even numbered data lines DL2, DL4, DL6 and DL8 are connected to the green subpixels. Accordingly, as shown in FIG. 4, the first driving gate signal TGR and the second driving gate signal TGB are alternately activated. In contrast, the third driving gate signal TGG may maintain an activated status when the first driving gate signal TGR and the second driving gate signal TGB are alternately activated. The activation level of the first to third driving gate signals TGR, TGB and TGG may be a low level.

The second voltage VGH applied to the normal inspecting transistors T34, T44, T54, T64 and T74 of the module crack and outermost inspector may be a DC voltage for inspection.

As shown in FIGS. 5 and 6, the third voltage VGHLP applied to the module crack inspecting transistor T84 of the module crack and outermost inspector may be a voltage having a level reduced from the second voltage VGH by a module crack detecting resistor RLOOP.

The module crack detecting resistor RLOOP may be formed by the module crack detecting line LOOP disposed in the peripheral region of the display panel 100.

The open-short inspector may include a first open-short inspecting transistor T13 and a second open-short inspecting transistor T23. The first open-short inspecting transistor T13 may include a control electrode for receiving a second test gate signal TGOS, an input electrode for receiving a first open-short test voltage TD1 and an output electrode connected to the first outermost data line DL1. The second open-short inspecting transistor T23 may include a control electrode for receiving the second test gate signal TGOS, an input electrode for receiving a second open-short test voltage TD2 and an output electrode connected to the second outermost data line DL2.

The open-short inspector may further include a third open-short inspecting transistor T33 and a fourth open-short inspecting transistor T43. The third open-short inspecting transistor T33 may include a control electrode for receiving the second test gate signal TGOS, an input electrode for receiving the first open-short test voltage TD1 and an output electrode connected to the third data line DL3. The fourth open-short inspecting transistor T43 may include a control electrode for receiving the second test gate signal TGOS, an input electrode for receiving the second open-short test voltage TD2 and an output electrode connected to the fourth data line DL4.

One of the first open-short test voltage TD1 and the second open-short test voltage TD2 may represent a high luminance image and the other may represent a low luminance image. Thus, the short between adjacent data lines may be determined.

Figure 7:
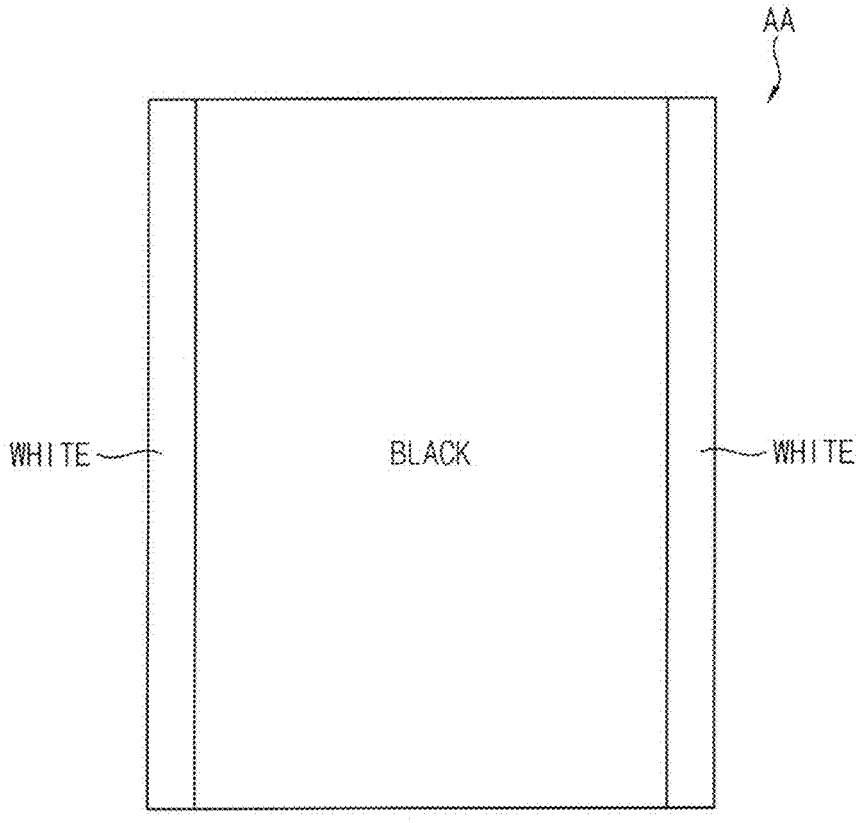
FIG. 7 is a conceptual diagram illustrating an exemplary test pattern displayed on the display panel of FIG. 1.

FIG. 7 is a conceptual diagram illustrating an exemplary test pattern displayed on the display panel 100 of FIG. 1.

Referring to FIGS. 1 to 7, in an example embodiment, the first voltage applied to the outermost inspecting transistors T14 and T24 of the module crack and outermost inspector may be the voltage used for the lighting-on inspection. The first voltage may be adjustable by the inspecting person and may be adjusted to a DC voltage. The second voltage VGH applied to the normal inspecting transistors T34, T44, T54, T64 and T74 of the module crack and outermost inspector may be a fixed DC voltage. The second voltage VGH may be a voltage for displaying a low luminance image.

As shown in FIG. 7, for the outermost area inspection, the first voltage may be adjusted to represent a high luminance image (WHITE) and the second voltage VGH may represent a low luminance image (BLACK) so that only the left outermost area and the right outermost area of the display region AA of the display panel 100 may display the high luminance image (WHITE). Thus, the non-deposition of the organic light emitting element which is frequently generated in the outermost area of the display region AA of the display panel 100 may be effectively inspected.

According to the present example embodiment, the test pattern representing a relatively high luminance is displayed in the outermost area of the display region AA of the display panel 100 so that the defect due to a non-deposition of the organic light emitting element in the outermost area of the display region AA of the display panel 100 may be effectively detected. Thus, the reliability of the inspection of the display panel 100 may be enhanced.

In addition, the outermost inspector to inspect the outermost area of the display region AA of the display panel 100 may be integrally formed with the module crack inspector so that the reliability of the inspection of the display panel 100 may be enhanced without enlarging the dead space of the display panel 100.

Figure 8:
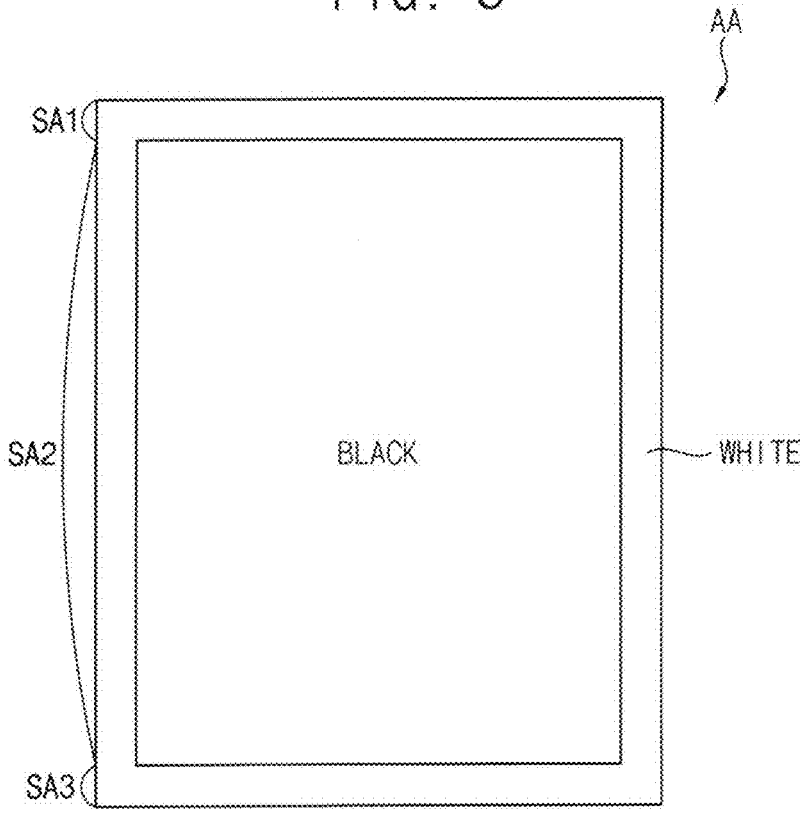
FIG. 8 is a conceptual diagram illustrating a test pattern displayed on a display panel of a display apparatus according to an example embodiment of the present inventive concept.
Figure 9:
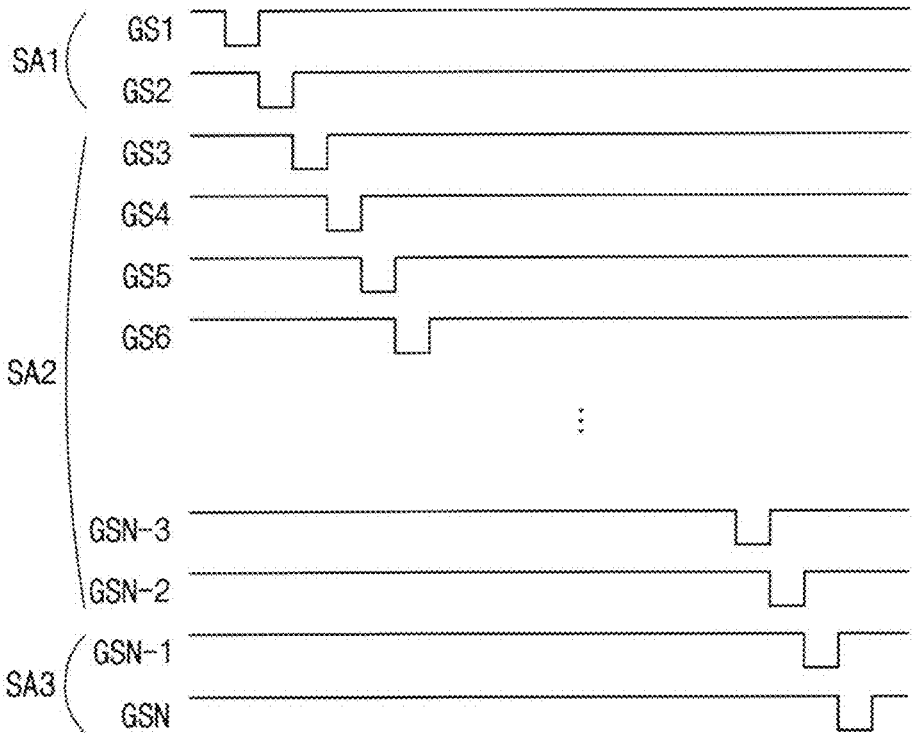
FIG. 9 is a timing diagram illustrating an exemplary gate signal applied to the display panel of FIG. 8.

FIG. 8 is a conceptual diagram illustrating a test pattern displayed on a display panel of a display apparatus according to an example embodiment of the present inventive concept. FIG. 9 is a timing diagram illustrating an exemplary gate signal applied to the display panel of FIG. 8.

The display panel inspecting apparatus and the display apparatus according to the illustrated example embodiment in FIGS. 8 and 9 are substantially the same as the display panel inspecting apparatus and the display apparatus explained referring to FIGS. 1 to 7, respectively, except for the test pattern displayed on the display panel for the outermost inspection. Thus, the same reference numerals will be used to refer to the same or like parts as those described in with reference to FIGS. 1 to 7, and any further repetitive explanation concerning the above elements will be omitted.

Referring to FIGS. 1 to 6 and 8, the display apparatus includes a display panel 100, a display panel inspector IP1 and a display panel driver. The display panel driver includes a gate driver 200 and a data driver 300.

The display panel inspector IP1 may include a lighting-on inspector T11, T12, T21, T31, T32, T41, T51, T52, T61, T71, T72 and T81, an open-short inspector T13, T23, T33, T43, T53, T63, T73 and T83 and a module crack and outermost inspector T14, T24, T34, T44, T54, T64, T74 and T84.

In the present example embodiment, the first voltage applied to the outermost inspecting transistors T14 and T24 of the module crack and outermost inspector may be the voltage used for the lighting-on inspection. The first voltage may be adjustable by the inspecting person and may be a DC voltage. The second voltage VGH applied to the normal inspecting transistors T34, T44, T54, T64 and T74 of the module crack and outermost inspector may be a fixed DC voltage. The second voltage VGH may be a voltage for displaying a low luminance image.

As shown in FIG. 8, for the outermost area inspection, the first voltage may be adjusted to represent a high luminance image (WHITE) and the second voltage VGH may represent a low luminance image (BLACK) so that only the left outermost area and the right outermost area of the display region AA of the display panel 100 may display the high luminance image (WHITE). Thus, the non-deposition of the organic light emitting element which is frequently generated in the outermost area of the display region AA of the display panel 100 may be effectively inspected.

In addition, in the present example embodiment, when the subpixels in the display region AA of the display panel 100 are scanned by gate signals GS1 to GSN outputted from the gate driver 200, grayscale voltages representing a high luminance are outputted to an upper outermost area SA1 (e.g. by adjusting the levels of DCR, DCB, DCG during the scan periods of the gate signals GS1 and GS2), grayscale voltages representing a low luminance are outputted to a normal area SA2 disposed between the upper outermost area SA1 and a lower outermost area SA3 (e.g. by adjusting the levels of DCR, DCB, DCG during the scan periods of the gate signals GS3 and GSN-2), and grayscale voltages representing a high luminance are outputted to the lower outermost area SA3 (e.g. by adjusting the levels of DCR, DCB, DCG during the scan periods of the gate signals GSN-1 and GSN).

Thus, the test pattern may have a high luminance displayed in the left outermost area, the right outermost area, the upper outermost area SA1 and the lower outermost area SA3 of the display region AA of the display panel 100, and a low luminance displayed in the display region AA except for the left outermost area, the right outermost area, the upper outermost area and the lower outermost area of the display region AA of the display panel 100.

According to the present example embodiment, the test pattern representing a relatively high luminance is displayed in the outermost area of the display region AA of the display panel 100 so that the defect due to a non-deposition of the organic light emitting element in the outermost area of the display region AA of the display panel 100 may be effectively detected. Thus, the reliability of the inspection of the display panel 100 may be enhanced.

In addition, the outermost inspector to inspect the outermost area of the display region AA of the display panel 100 may be integrally formed with the module crack inspector so that the reliability of the inspection of the display panel 100 may be enhanced without enlarging the dead space of the display panel 100.

Figure 10:
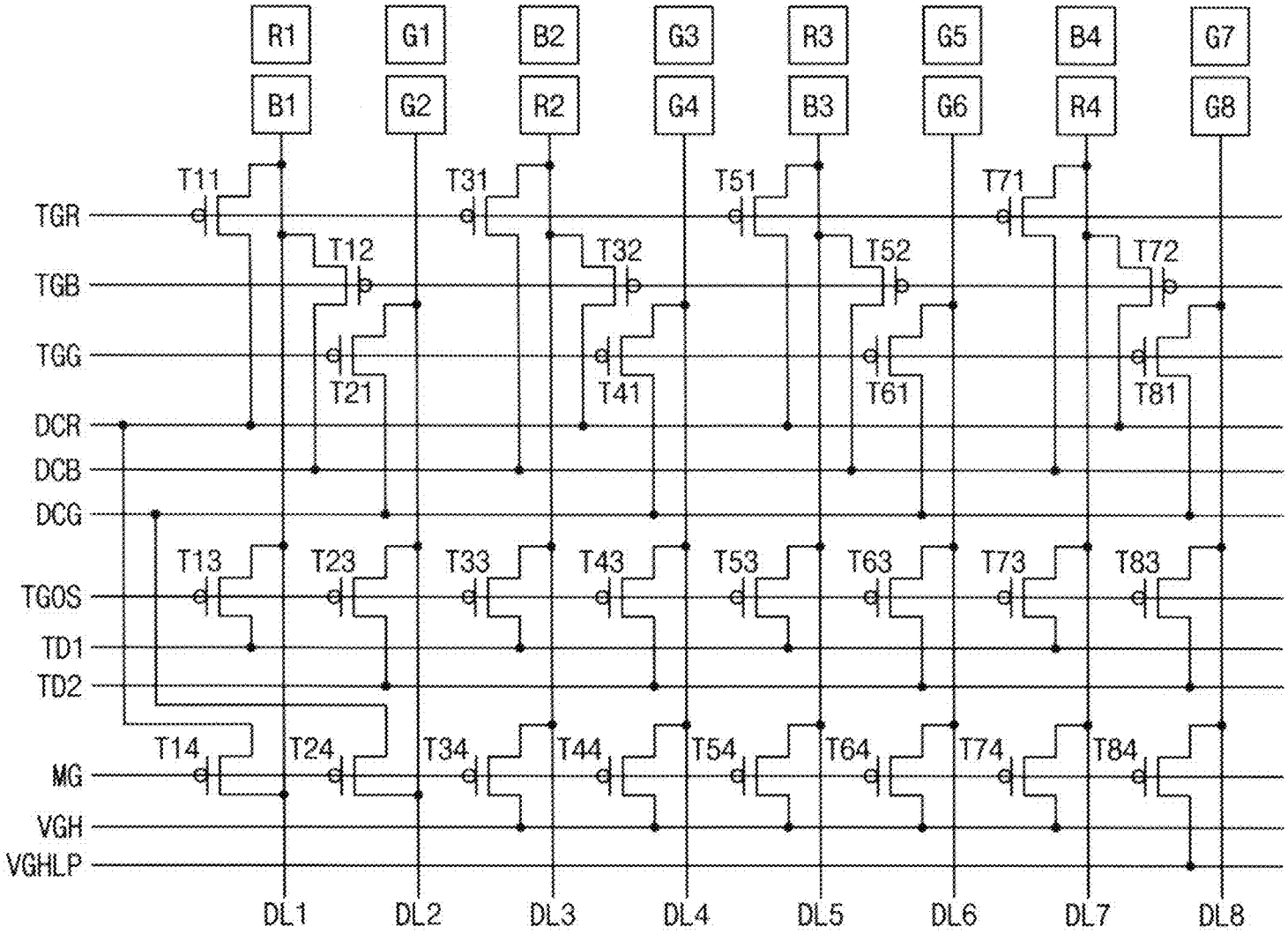
FIG. 10 is a circuit diagram illustrating a display panel inspector of a display apparatus according to another example embodiment of the present inventive concept.

FIG. 10 is a circuit diagram illustrating a display panel inspector of a display apparatus according to another example embodiment of the present inventive concept.

The display panel inspecting apparatus and the display apparatus according to the illustrated example embodiment in FIG. 10 are substantially the same as the display panel inspecting apparatus and the display apparatus explained referring to FIGS. 1 to 7, respectively, except for the structure of the display panel inspector. Thus, the same reference numerals will be used to refer to the same or like parts as those described in with reference to FIGS. 1 to 7, and any further repetitive explanation concerning the above elements will be omitted.

Referring to FIGS. 1 and 10, the display apparatus includes a display panel 100, a display panel inspector IP1 and a display panel driver. The display panel driver includes a gate driver 200 and a data driver 300.

The display panel inspector IP1 may include a lighting-on inspector T11, T12, T21, T31, T32, T41, T51, T52, T61, T71, T72 and T81, an open-short inspector T13, T23, T33, T43, T53, T63, T73 and T83, and a module crack and outermost inspector T14, T24, T34, T44, T54, T64, T74 and T84.

In the present example embodiment, the module crack and outermost inspector may include transistors of three different types which are distinguished according to voltages applied to input electrodes. For example, the module crack and outermost inspector may include outermost inspecting transistor T14 and T24 for the outermost inspection, the normal inspecting transistor T34, T44, T54, T64 and T74, and the module crack inspecting transistor T84 for the module crack inspection. In the present example embodiment, the term "first voltage" refers to the voltage applied to the input electrode of the outermost inspecting transistor T14, and the term "fourth voltage" refers to the voltage applied to the input electrode of the outermost inspecting transistor T24.

A first outermost inspecting transistor T14 may include a control electrode for receiving a first test gate signal MG, an input electrode for receiving the first voltage and an output electrode connected to a first outermost data line DL1 disposed in the outermost area of the display region AA of the display panel 100.

A second outermost inspecting transistor T24 may include a control electrode for receiving the first test gate signal MG, an input electrode for receiving the fourth voltage different from the first voltage and an output electrode connected to a second outermost data line DL2 disposed in the outermost area of the display region AA of the display panel 100 and adjacent to the first outermost data line DL1.

In the present example embodiment, the first voltage may be a first color grayscale voltage DCR. The fourth voltage may be a third color grayscale voltage DCG. Herein, the first color grayscale voltage DCR may be a red grayscale voltage. Herein, the third color grayscale voltage DCG may be a green grayscale voltage. For example, the first voltage and the fourth voltage may be adjustable by an inspecting person. For example, the first voltage and the fourth voltage may be a DC voltage. The first voltage and the fourth voltage are the gray scale voltages for different colors so that levels of the first voltage and the fourth voltage to represent a full grayscale value may be different from each other.

According to the present example embodiment, the test pattern representing a relatively high luminance is displayed in the outermost area of the display region AA of the display panel 100 so that the defect due to a non-deposition of the organic light emitting element in the outermost area of the display region AA of the display panel 100 may be effectively detected. Thus, the reliability of the inspection of the display panel 100 may be enhanced.

In addition, the outermost inspector to inspect the outermost area of the display region AA of the display panel 100 may be integrally formed with the module crack inspector so that the reliability of the inspection of the display panel 100 may be enhanced without enlarging the dead space of the display panel 100.

Figure 11:
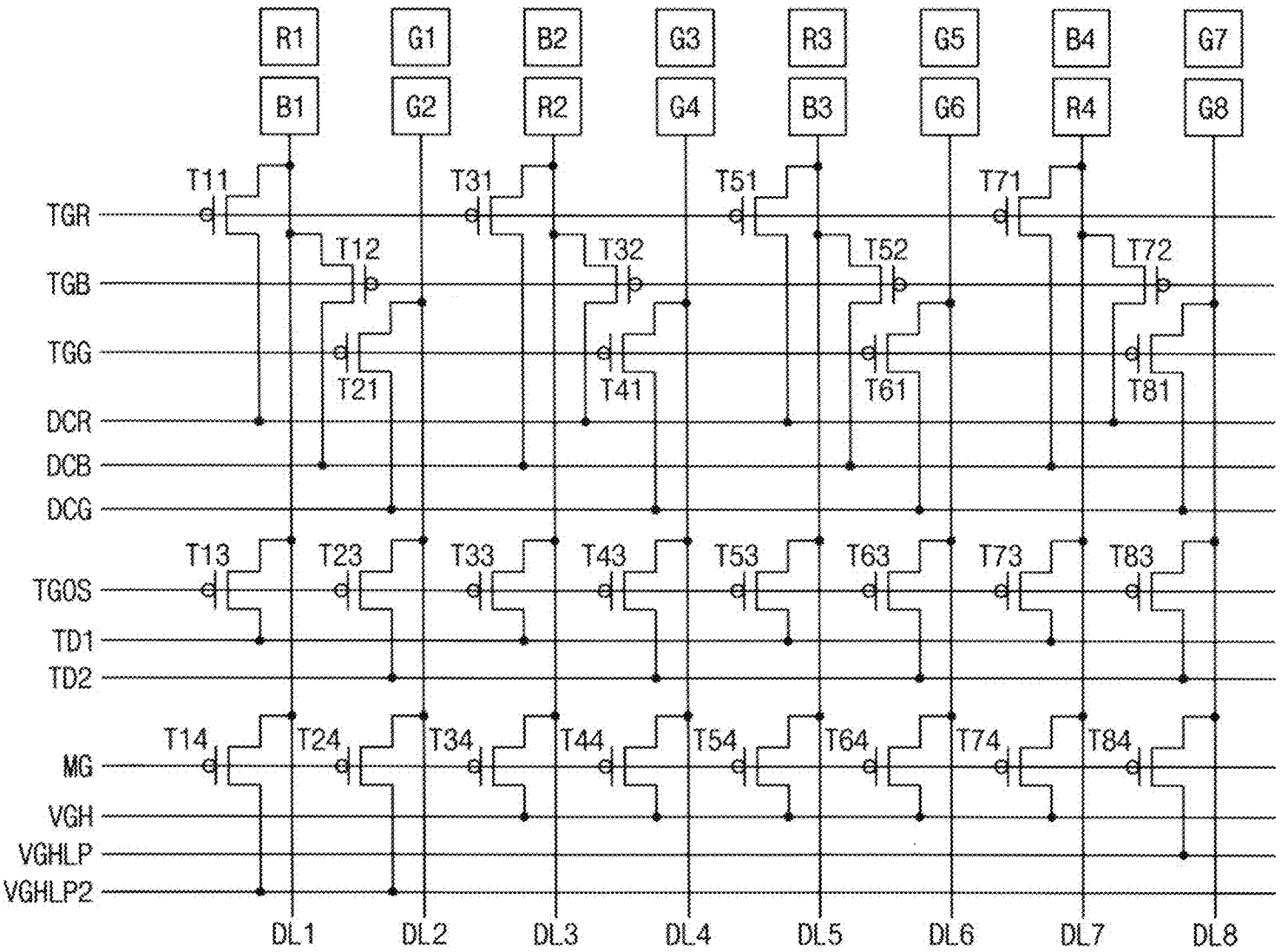
FIG. 11 is a circuit diagram illustrating a display panel inspector of a display apparatus according to still another example embodiment of the present inventive concept.
Figure 12:
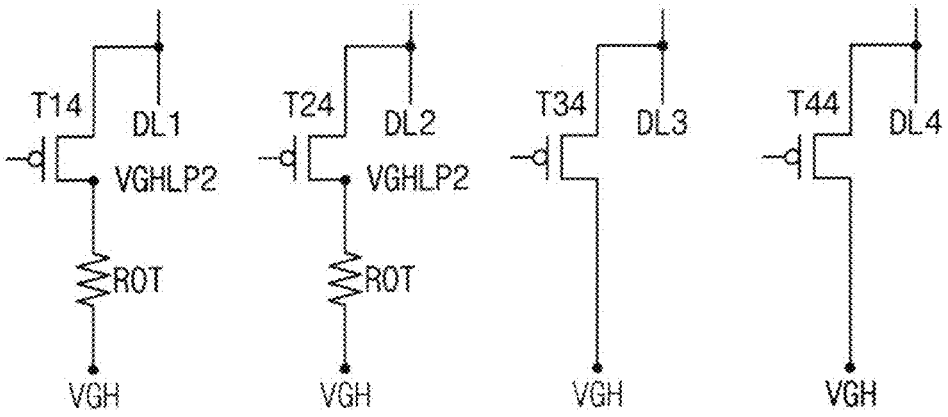
FIG. 12 is a circuit diagram illustrating an exemplary embodiment of an outermost inspecting transistor and a normal inspecting transistor of FIG. 11.

FIG. 11 is a circuit diagram illustrating a display panel inspector of a display apparatus according to still another example embodiment of the present inventive concept. FIG. 12 is a circuit diagram illustrating an exemplary embodiment of an outermost inspecting transistor and a normal inspecting transistor of FIG. 11.

The display panel inspecting apparatus and the display apparatus according to the illustrated example embodiment are substantially the same as the display panel inspecting apparatus and the display apparatus explained referring to FIGS. 1 to 7, respectively, except for the structure of the display panel inspector. Thus, the same reference numerals will be used to refer to the same or like parts as those described in with reference to FIGS. 1 to 7, and any further repetitive explanation concerning the above elements will be omitted.

Referring to FIGS. 1, 11 and 12, the display apparatus includes a display panel 100, a display panel inspector IP1 and a display panel driver. The display panel driver includes a gate driver 200 and a data driver 300.

The display panel inspector IP1 may include a lighting-on inspector T11, T12, T21, T31, T32, T41, T51, T52, T61, T71, T72 and T81, an open-short inspector T13, T23, T33, T43, T53, T63, T73 and T83, and a module crack and outermost inspector T14, T24, T34, T44, T54, T64, T74 and T84.

In the present example embodiment, the module crack and outermost inspector may include transistors of three different types which are distinguished according to voltages applied to input electrodes. For example, the module crack and outermost inspector may include outermost inspecting transistor T14 and T24 for the outermost inspection, the normal inspecting transistor T34, T44, T54, T64 and T74, and the module crack inspecting transistor T84 for the module crack inspection.

A first outermost inspecting transistor T14 may include a control electrode for receiving a first test gate signal MG, an input electrode for receiving a first voltage VGHLP2 and an output electrode connected to a first outermost data line DL1 disposed in the outermost area of the display region AA of the display panel 100.

A second outermost inspecting transistor T24 may include a control electrode for receiving the first test gate signal MG, an input electrode for receiving the first voltage VGHLP2 and an output electrode connected to a second outermost data line DL2 disposed in the outermost area of the display region AA of the display panel 100 and adjacent to the first outermost data line DL1.

In the present example embodiment, a second voltage VGH applied to input electrodes of the normal inspecting transistor T34, T44, T54, T64 and T74 may be a DC voltage for inspection. The first voltage VGHLP2 may be a voltage having a level reduced from the second voltage VGH by a resistor ROT as shown in FIG. 12.

Due to the reduced level of the first voltage VGHLP2, the first voltage VGHLP2 may represent a high luminance image, and the second voltage VGH may represent a low luminance image. Thus, only the left outermost area and the right outermost area of the display region AA of the display panel 100 display the high luminance image so that the non-deposition of the organic light emitting element which is frequently generated in the outermost area of the display region AA of the display panel 100 may be effectively inspected.

According to the present example embodiment, the test pattern representing a relatively high luminance is displayed in the outermost area of the display region AA of the display panel 100 so that the defect due to a non-deposition of the organic light emitting element in the outermost area of the display region AA of the display panel 100 may be effectively detected. Thus, the reliability of the inspection of the display panel 100 may be enhanced.

In addition, the outermost inspector to inspect the outermost area of the display region AA of the display panel 100 may be integrally formed with the module crack inspector so that the reliability of the inspection of the display panel 100 may be enhanced without enlarging the dead space of the display panel 100.

Figure 13:
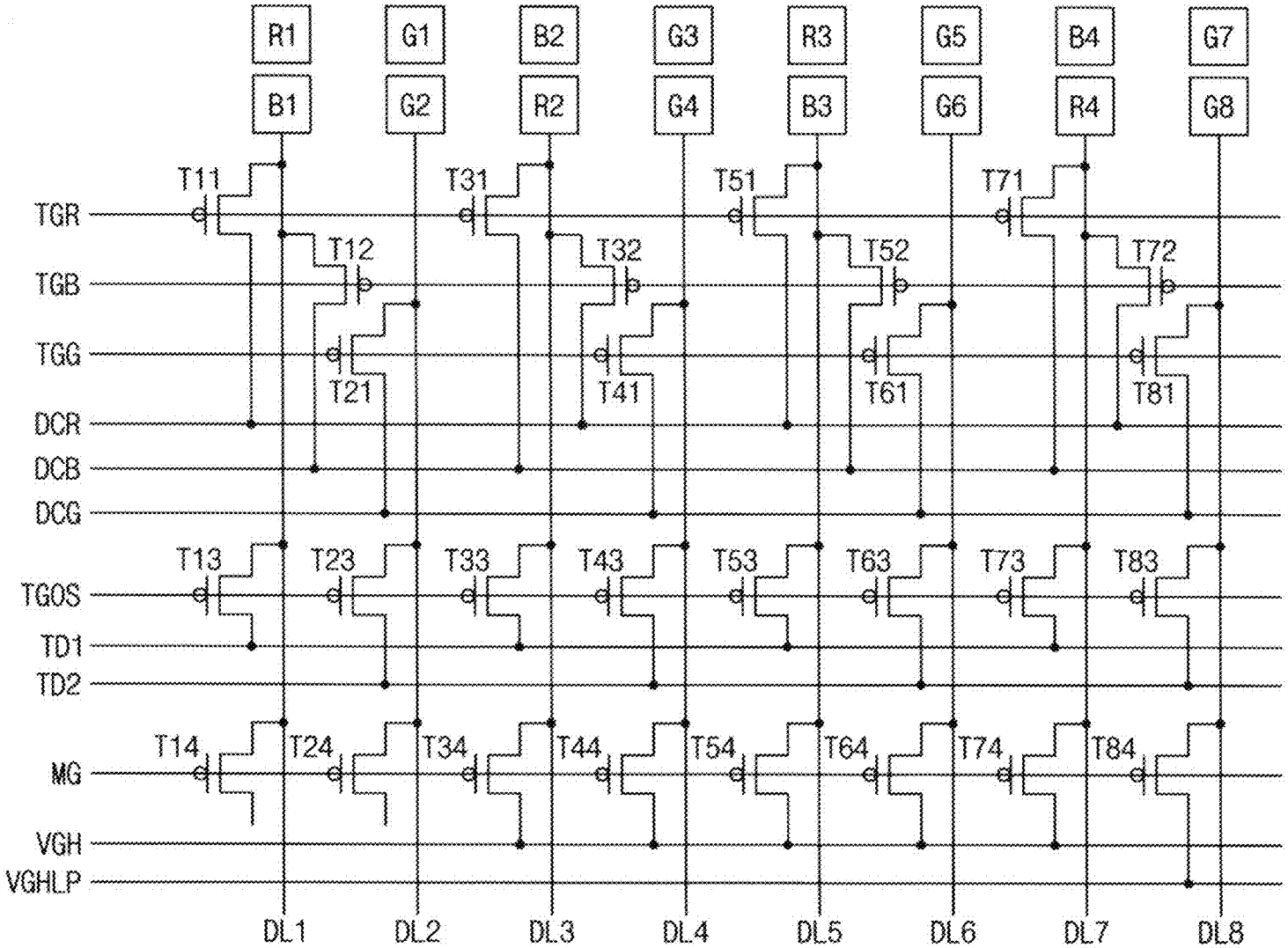
FIG. 13 is a circuit diagram illustrating a display panel inspector of a display apparatus according to yet another example embodiment of the present inventive concept.

FIG. 13 is a circuit diagram illustrating a display panel inspector of a display apparatus according to yet another example embodiment of the present inventive concept.

The display panel inspecting apparatus and the display apparatus according to the illustrated example embodiment in FIG. 13 are substantially the same as the display panel inspecting apparatus and the display apparatus explained referring to FIGS. 1 to 7, respectively, except for the structure of the display panel inspector. Thus, the same reference numerals will be used to refer to the same or like parts as those described in with reference to FIGS. 1 to 7, and any further repetitive explanation concerning the above elements will be omitted.

Referring to FIGS. 1 and 13, the display apparatus includes a display panel 100, a display panel inspector IP1 and a display panel driver. The display panel driver includes a gate driver 200 and a data driver 300.

The display panel inspector IP1 may include a lighting-on inspector T11, T12, T21, T31, T32, T41, T51, T52, T61, T71, T72 and T81, an open-short inspector T13, T23, T33, T43, T53, T63, T73 and T83, and a module crack and outermost inspector T14, T24, T34, T44, T54, T64, T74 and T84.

In the present example embodiment, the module crack and outermost inspector may include transistors of three different types which are distinguished according to voltages applied to input electrodes. For example, the module crack and outermost inspector may include outermost inspecting transistor T14 and T24 for the outermost inspection, the normal inspecting transistor T34, T44, T54, T64 and T74, and the module crack inspecting transistor T84 for the module crack inspection.

A first outermost inspecting transistor T14 may include a control electrode for receiving a first test gate signal MG, an input electrode which is floated, and an output electrode connected to a first outermost data line DL1 disposed in the outermost area of the display region AA of the display panel 100.

A second outermost inspecting transistor T24 may include a control electrode for receiving the first test gate signal MG, an input electrode which is floated, and an output electrode connected to a second outermost data line DL2 disposed in the outermost area of the display region AA of the display panel 100 and adjacent to the first outermost data line DL1.

In the present example embodiment, a second voltage VGH applied to input electrodes of the normal inspecting transistor T34, T44, T54, T64 and T74 may be a DC voltage for inspection. An input voltage of the first and second outermost inspecting transistors T14 and T24 may be a floating voltage due to disconnection.

The floating voltage may represent a high luminance image, and the second voltage VGH may represent a low luminance image. Thus, only the left outermost area and the right outermost area of the display region AA of the display panel 100 display the high luminance image so that the non-deposition of the organic light emitting element which is frequently generated in the outermost area of the display region AA of the display panel 100 may be effectively inspected.

According to the present example embodiment, the test pattern representing a relatively high luminance is displayed in the outermost area of the display region AA of the display panel 100 so that the defect due to a non-deposition of the organic light emitting element in the outermost area of the display region AA of the display panel 100 may be effectively detected. Thus, the reliability of the inspection of the display panel 100 may be enhanced.

In addition, the outermost inspector to inspect the outermost area of the display region AA of the display panel 100 may be integrally formed with the module crack inspector so that the reliability of the inspection of the display panel 100 may be enhanced without enlarging the dead space of the display panel 100.

Figure 14:
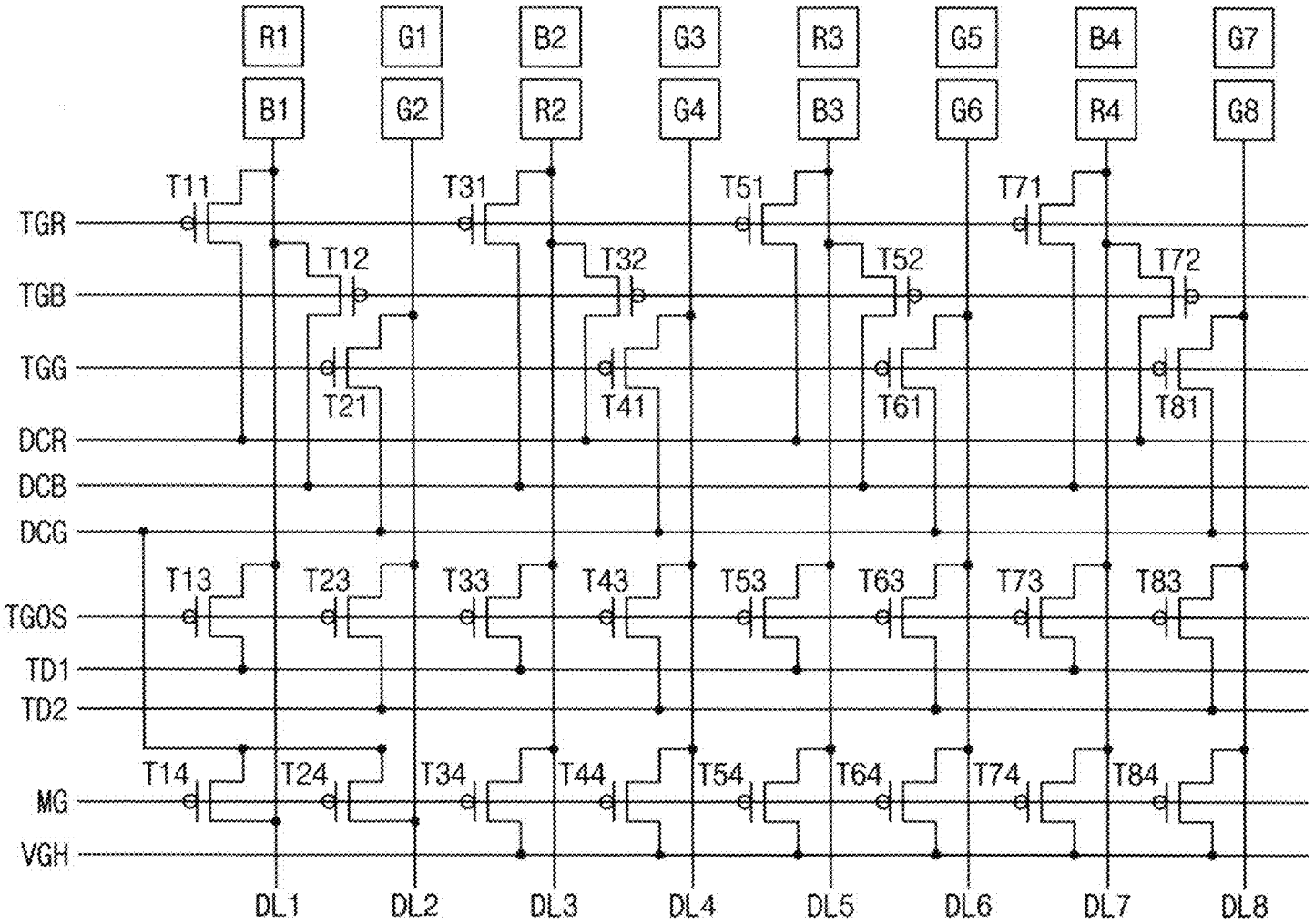
FIG. 14 is a circuit diagram illustrating a display panel inspector of a display apparatus according to still another example embodiment of the present inventive concept.

FIG. 14 is a circuit diagram illustrating a display panel inspector of a display apparatus according to still another example embodiment of the present inventive concept.

The display panel inspecting apparatus and the display apparatus according to the illustrated example embodiment are substantially the same as the display panel inspecting apparatus and the display apparatus explained referring to FIGS. 1 to 7, respectively, except for the structure of the display panel inspector. Thus, the same reference numerals will be used to refer to the same or like parts as those described in with reference to FIGS. 1 to 7, and any further repetitive explanation concerning the above elements will be omitted.

Referring to FIGS. 1 and 13, the display apparatus includes a display panel 100, a display panel inspector IP1 and a display panel driver. The display panel driver includes a gate driver 200 and a data driver 300.

The display panel inspector IP1 may include a lighting-on inspector T11, T12, T21, T31, T32, T41, T51, T52, T61, T71, T72 and T81, an open-short inspector T13, T23, T33, T43, T53, T63, T73 and T83, and an outermost inspector T14, T24, T34, T44, T54, T64, T74 and T84.

In the present example embodiment, the outermost inspector may include transistors of two different types which are distinguished according to voltages applied to input electrodes. For example, the outermost inspector may include outermost inspecting transistor T14 and T24 for the outermost inspection and the normal inspecting transistor T34, T44, T54, T64, T74 and T84.

A first outermost inspecting transistor T14 may include a control electrode for receiving a first test gate signal MG, an input electrode for receiving a first voltage and an output electrode connected to a first outermost data line DL1 disposed in the outermost area of the display region AA of the display panel 100.

A second outermost inspecting transistor T24 may include a control electrode for receiving the first test gate signal MG, an input electrode for receiving the first voltage, and an output electrode connected to a second outermost data line DL2 disposed in the outermost area of the display region AA of the display panel 100 and adjacent to the first outermost data line DL1. In the present example embodiment, the first voltage may be the third color grayscale voltage DCG.

In the present example embodiment, the first voltage may be adjustable by an inspecting person. For example, the first voltage may be a direct current (DC) voltage. For example, a second voltage VGH applied to the normal inspecting transistor T34, T44, T54, T64, T74 and T84 may be a fixed DC voltage. The second voltage may be a voltage for displaying a low luminance image.

When the first voltage represents a high luminance image and the second voltage VGH represents a low luminance image, only the left outermost area and the right outermost area of the display region AA of the display panel 100 display the high luminance image so that the non-deposition of the organic light emitting element which is frequently generated in the outermost area of the display region AA of the display panel 100 may be effectively inspected.

In the present example embodiment, the outermost inspector may be independently disposed from the module crack inspector of FIG. 3.

According to the present example embodiment, the test pattern representing a relatively high luminance is displayed in the outermost area of the display region AA of the display panel 100 so that the defect due to a non-deposition of the organic light emitting element in the outermost area of the display region AA of the display panel 100 may be effectively detected. Thus, the reliability of the inspection of the display panel 100 may be enhanced.

According to the present inventive concept as explained above, the reliability of the display panel inspection may be enhanced.

The foregoing is illustrative of the inventive concept and is not to be construed as limiting thereof. Although a few example embodiments of the inventive concept have been described, those skilled in the art will readily appreciate that many modifications are possible in the example embodiments without materially departing from the novel teachings and advantages of the inventive concept. Accordingly, all such modifications are intended to be included within the scope of the inventive concept as defined in the claims. In the claims, means-plus-function clauses are intended to cover the structures described herein as performing the recited function and not only structural equivalents but also equivalent structures. Therefore, it is to be understood that the foregoing is illustrative of the inventive concept and is not to be construed as limited to the specific example embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. A display panel inspecting apparatus comprising:

a first inspecting transistor comprising a control electrode which receives a first test gate signal, an input electrode which receives a first voltage and an output electrode connected to a first outermost data line disposed in an outermost area of a display region of a display panel;

a second inspecting transistor comprising a control electrode which receives the first test gate signal, an input electrode which receives a second voltage and an output electrode connected to a normal data line disposed out of the outermost area of the display region of the display panel; and a third inspecting transistor comprising a control electrode which receives the first test gate signal, an input electrode which receives a third voltage and an output electrode connected to a module crack inspecting data line disposed out of the outermost area of the display region of the display panel, wherein the normal data line is disposed between the first outermost data line and the module crack inspecting data line.

2. The display panel inspecting apparatus of claim 1, wherein the first voltage is a first color grayscale voltage.

3. The display panel inspecting apparatus of claim 1, further comprising a fourth inspecting transistor comprising a control electrode which receives the first test gate signal, an input electrode which receives the first voltage and an output electrode connected to a second outermost data line disposed in the outermost area of the display region of the display panel and adjacent to the first outermost data line.

4. The display panel inspecting apparatus of claim 1, further comprising a fourth inspecting transistor comprising a control electrode which receives the first test gate signal, an input electrode which receives a fourth voltage and an output electrode connected to a second outermost data line disposed in the outermost area of the display region of the display panel and adjacent to the first outermost data line.

5. The display panel inspecting apparatus of claim 4, wherein the fourth voltage is a first color grayscale voltage, and wherein the first voltage is a second color grayscale voltage.

6. The display panel inspecting apparatus of claim 1, wherein the second voltage is an inspection direct current (DC) voltage, and wherein the first voltage is a voltage having a level reduced from the second voltage by a resistor.

7. The display panel inspecting apparatus of claim 1, wherein the input electrode of the first inspecting transistor is floated, and wherein the first voltage is a floating voltage.

8. The display panel inspecting apparatus of claim 1, further comprising:

a first driving transistor comprising a control electrode which receives a first driving gate signal, an input electrode which receives a first color grayscale voltage and an output electrode connected to the first outermost data line;

a second driving transistor comprising a control electrode which receives a second driving gate signal, an input electrode which receives a second color grayscale voltage and an output electrode connected to the first outermost data line; and a third driving transistor comprising a control electrode which receives a third driving gate signal, an input electrode which receives a third color grayscale voltage and an output electrode connected to a second outermost data line disposed in the outermost area of the display region of the display panel and adjacent to the first outermost data line.

9. The display panel inspecting apparatus of claim 8, wherein the first driving gate signal and the second driving gate signal are alternately activated, and wherein the third driving gate signal maintains an activated status when the first driving gate signal and the second driving gate signal are alternately activated.

10. The display panel inspecting apparatus of claim 1, wherein the second voltage is an inspection direct current (DC) voltage, and wherein the third voltage is a voltage having a level reduced from the second voltage by a module crack detecting resistor.

11. The display panel inspecting apparatus of claim 10, wherein the module crack detecting resistor is formed by a module crack detecting line disposed in a peripheral region of the display panel.

12. The display panel inspecting apparatus of claim 1, further comprising:

a first open-short inspecting transistor comprising a control electrode which receives a second test gate signal, an input electrode which receives a first open-short test voltage and an output electrode connected to the first outermost data line; and a second open-short inspecting transistor comprising a control electrode which receives the second test gate signal, an input electrode which receives a second open-short test voltage and an output electrode connected to a second outermost data line disposed in the outermost area of the display region of the display panel and adjacent to the first outermost data line.

13. The display panel inspecting apparatus of claim 1, wherein the display panel displays a test pattern, and wherein the test pattern has a first luminance displayed in a left outermost area and a right outermost area of the display region of the display panel and a second luminance displayed in an area between the left outermost area and the right outermost area of the display region of the display panel.

14. The display panel inspecting apparatus of claim 1, wherein the display panel displays a test pattern, and wherein the test pattern has a first luminance displayed in a left outermost area, a right outermost area, an upper outermost area and a lower outermost area of the display region of the display panel and a second luminance displayed in a display region of the display panel except for the left outermost area, the right outermost area, the upper outermost area and the lower outermost area of the display region of the display panel.

15. A display panel inspecting apparatus comprising:

a first inspecting transistor comprising a control electrode which receives a first test gate signal, an input electrode which receives a first voltage and an output electrode connected to an outermost data line disposed in an outermost area of a display region of a display panel; and a second inspecting transistor comprising a control electrode which receives the first test gate signal, an input electrode which receives a second voltage and an output electrode connected to a normal data line disposed out of the outermost area of the display region of the display panel, wherein the first voltage represents a high luminance image displayed only in the outermost area, while the second voltage represents a low luminance image displayed outside the outermost area.

16. A display apparatus comprising:

a display panel comprising a plurality of gate lines, a plurality of data lines and a plurality of subpixels connected to the gate lines and the data lines; and a display panel inspector comprising:

a first inspecting transistor comprising a control electrode which receives a first test gate signal, an input electrode which receives a first voltage and an output electrode connected to a first outermost data line disposed in an outermost area of a display region of the display panel;

a second inspecting transistor comprising a control electrode which receives the first test gate signal, an input electrode which receives a second voltage and an output electrode connected to a normal data line disposed out of the outermost area of the display region of the display panel; and a third inspecting transistor comprising a control electrode which receives the first test gate signal, an input electrode which receives a third voltage and an output electrode connected to a module crack inspecting data line disposed out of the outermost area of the display region of the display panel, wherein the normal data line is disposed between the first outermost data line and the module crack inspecting data line.

17. The display apparatus of claim 16, wherein the first voltage is a first color grayscale voltage.

18. The display apparatus of claim 16, wherein the display panel inspector further comprises a fourth inspecting transistor comprising a control electrode which receives the first test gate signal, an input electrode which receives the first voltage and an output electrode connected to a second outermost data line disposed in the outermost area of the display region of the display panel and adjacent to the first outermost data line.

19. The display apparatus of claim 16, wherein the display panel inspector further comprises:

a first driving transistor comprising a control electrode which receives a first driving gate signal, an input electrode which receives a first color grayscale voltage and an output electrode connected to the first outermost data line;

a second driving transistor comprising a control electrode which receives a second driving gate signal, an input electrode which receives a second color grayscale voltage and an output electrode connected to the first outermost data line; and a third driving transistor comprising a control electrode which receives a third driving gate signal, an input electrode which receives a third color grayscale voltage and an output electrode connected to a second outermost data line disposed in the outermost area of the display region of the display panel and adjacent to the first outermost data line.

20. The display apparatus of claim 16, wherein the display panel inspector further comprises:

a first open-short inspecting transistor comprising a control electrode which receives a second test gate signal, an input electrode which receives a first open-short test voltage and an output electrode connected to the first outermost data line; and a second open-short inspecting transistor comprising a control electrode which receives the second test gate signal, an input electrode which receives a second open-short test voltage and an output electrode connected to a second outermost data line disposed in the outermost area of the display region of the display panel and adjacent to the first outermost data line.

* * * * *